US006032708A

United States Patent [19]

Knorr

[11] Patent Number: 6,032,708

[45] Date of Patent: Mar. 7, 2000

[54] RADIAL SAWING LOG HOLDER AND METHOD

[75] Inventor: Andrew Karl Knorr, Yarram, Australia

[73] Assignee: The Australian Radial Timber Conversion Company Pty. Ltd., Yarram, Australia

[21] Appl. No.: 09/077,127

[22] PCT Filed: Nov. 21, 1996

[86] PCT No.: PCT/AU96/00742

§ 371 Date: May 22, 1998

§ 102(e) Date: May 22, 1998

[87] PCT Pub. No.: WO97/18930

PCT Pub. Date: May 29, 1997

[30] Foreign Application Priority Data

Nov. 22, 1995 [AU] Australia ..... PN 6724

[51] Int. Cl.[7] ..... B27B 1/00

[52] U.S. Cl. ..... 144/378; 83/471.2; 83/708; 144/242.1; 144/245.1; 144/363; 269/63

[58] Field of Search ..... 269/20, 43, 45, 269/54.4, 63, 70; 83/704–708, 471.1, 471.2, 471.3, 433, 435.1; 144/242.1, 245.1, 376, 377, 378, 1.1, 2.1, 3.1, 363, 250.23

[56] References Cited

U.S. PATENT DOCUMENTS

| | | | |
|---|---|---|---|
| 2,393,940 | 1/1946 | Stamm . | |
| 3,044,511 | 7/1962 | Wieckman et al. | 83/708 |
| 4,068,695 | 1/1978 | Seaman | 83/471.2 |
| 4,287,798 | 9/1981 | Cooper, Jr. et al. | 83/708 |
| 4,394,409 | 7/1983 | Hertel . | |
| 4,489,635 | 12/1984 | Cooper | 83/708 |
| 4,936,559 | 6/1990 | Diaz Torga | 269/63 |
| 5,109,899 | 5/1992 | Henderickson | 144/378 |
| 5,253,685 | 10/1993 | Wolf | 144/378 |

*Primary Examiner*—W. Donald Bray
*Attorney, Agent, or Firm*—Davis and Bujold

[57] ABSTRACT

A method of log sawmilling capable of producing quartersawn boards, backsawn boards, trapezoidal sections and radial sector wedges for direct use and further processing, comprising the steps of: (a) sawing a log or logs into radial sector wedges with predetermined angles between the radial face, (b) separating wedges or batches of wedges for processing by separate or integrated means into backsawn boards, quartersawn boards, trapezoidal sections or further divided sector wedges. A holding apparatus to enable the practical sawing of logs to produce radially sawn wedge sectors of timber, said holding apparatus incorporating devices with a predetermined number of fingers or holding arms that: apply pressure, force and/or restrictive means to hold and support logs at both ends, hold a log in position in relation to a chosen central longitudinal axis, rotate around the same longitudinal axis as the log, hold individual sectors of the end of a log, allow sawcuts to be made along the radii of the sectors of the log to form individual wedges of timber, allow clearance for the sawblade so that a complete cut along the full length of the log can be made at the required depth, hold the wedges of timber after being sawn, release individual wedges at a determined time, adjust for length to hold logs with uneven ends or with ends that are not at right angles to the axis of rotation.

7 Claims, 4 Drawing Sheets

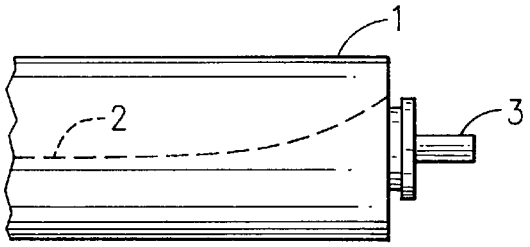
FIG.1
Prior Art
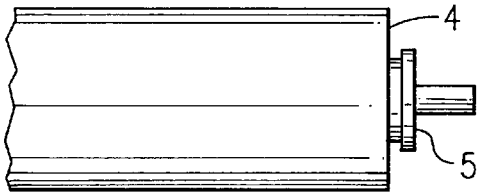
FIG.2
Prior Art
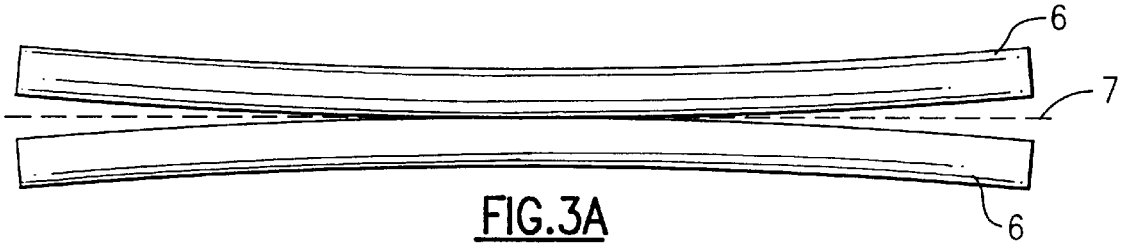
FIG.3A
FIG.3B
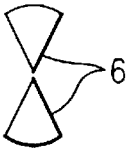
FIG.4
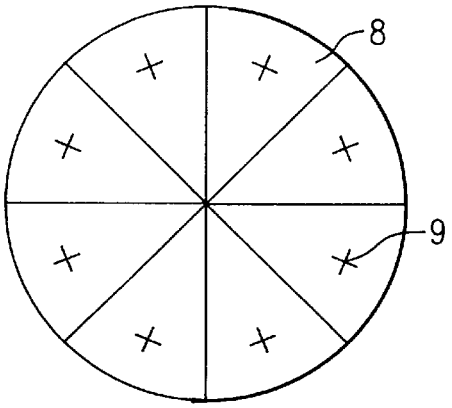

RADIAL SAWING LOG HOLDER AND METHOD

The present invention relates to an apparatus for the sawing of radial wedges of timber from a log and a method for further processing sawn wedges into a range of timber products.

BACKGROUND OF THE INVENTION

Radial sawing involves sawing elongated wedges of timber from a log so that the resulting wedges have two radial faces that are essentially formed by sawing the log along planes parallel to radii extending from a selected centre of the log along the longitudinal axis of the log.

Radial sawing logs allows for increased recovery of usable timber from a log and timber products with consistent growth ring orientation.

These advantages have been outlined fully by Hasenwinkle U.S. Pat. No. 3,903,943 and Knörr Australian Patent No. 623344, and Knorr U.S. Pat. No. 5,560,409.

Although radial sawing offers many theoretical and practical advantages, industry has not generally adopted or developed the method.

Prior art does not disclose a method for a production process involving radial sawing logs to wedges with the subsequent ability to produce backsawn boards, quartersawn boards, further divided radial wedges or trapezoidal timber sections if required. Prior art discloses sawing devices which appear cumbersome or which because of the use of multiple blades would be expensive to build and difficult to operate and maintain.

Also, none of these devices allow for the economical and practical sawing of logs with growth stresses. These stresses which are particularly strong in small diameter hardwood trees are adversely affecting the timber industry as old growth type forests are cut out and the timber resource comes increasingly from regrowth and plantation timbers.

Australian Patent No. 623344 does disclose a method for the production of radial wedges from all logs including logs that contain growth stresses. The method involves the mounting of logs in holding devices which hold the ends of the logs. These holding devices allow the log to be rotated along their longitudinal axis and for saw cuts to be made at predetermined angles basically from the outside to the centre along the length of the log. Although this has many advantages it does not provide a practical method of integrated operation that does not involve sawing of the end of the log or additional cuts to separate the wedges after the radial sawing process.

SUMMARY OF THE INVENTION

The present invention relates to a device that enables complete cuts to be made along the fill length of the log at the required depth enabling the integrated production of a range of timber products. The device provides for improved log and wedge holding ability and is comparatively simple to construct and use. The device allows for logs with uneven ends. This is typical of logs coming into the log yard and logs being docked in the log yard for sawing, as in practice it is virtually impossible to regularly dock ends square to the longitudinal axis of the tree.

The device allows for the containment of growth stresses during the sawing process and the even release of growth stresses into the individual wedges at the end of the sawing process. The device has for a disadvantage that the number of and angle between the full cuts that can be carried out on the device is limited to the pattern of the initial manufacture.

The restrictive nature of the device can be used to advantage in further processing to maximise recovery of sawn timber from a log to increase the versatility of the overall production line and products produced and to ensure that logs go to their highest value usage.

It is not generally possible to ascertain the quality of the internal timber in a log. Depending on log quality initial cuts can be very important to subsequent recovery and usage of timber. Decisions in regard to this can take time and a high degree of skill. A standard sawing or "breaking down" procedure that can channel initial broken down product for further standardized or customized production can have significant advantages especially in the selection of high quality timbers from the sawing line. The present invention has for its object a standardized system of breaking down logs into wedge sectors which provides the ability for the making of a decision about the best use for the log once the internal timber quality can be seen, and a device for the object's practical application. For example, quartersawn faces of timber (i.e. radial faces in a radial sawing process) can have special grain characteristics which are highly prized. Wedges showing these characteristics can be selected from the process to be further processed to the required product and possible highest value.

Wedges in their broken down state can be assessed for size, quality, defect or special characteristics and channelled for further processing.

Further processing can include resawing wedges for backsawn boards (i.e. sawing from radial face to radial face to make backsawn boards which basically have their growth rings tangential to the broad face), resawing wedges to produce further divided sector wedges, resawing parallel to the radial faces to produce quartersawn boards (i.e. boards with growth rings basically at right angles to the broad face) and resawing wedges to produce trapezoidal sections that may not be classed as either quartersawn or backsawn.

The basic embodiment of a device for the application of the invention involves a device with a predetermined number of fingers or holding arms that

- apply pressure, force and restrictive means to hold and support logs at both ends
- hold a log in position in relation to a chosen central longitudinal axis
- rotate around the same longitudinal axis as the log
- hold individual sectors of the end of a log
- allow sawcuts to be made along the radii of the sectors of the log to form individual wedges of timber
- allow clearance for the sawblade so that a complete cut along the full length of the log can be made at the required depth.
- hold the wedges of timber after being sawn
- release individual wedges at a determined time
- adjust for length to hold logs with uneven ends or that are not at right angles to the axis of rotation
- allow for the practical integrated production of a range of timber products In one preferred embodiment of the invention individual holding fingers are round bars or pipes which have the ability to slide in and out parallel to the axis of the log. The pins are mounted in supporting holes arranged in a circular fashion to match the required cutting pattern with examples being six pins arranged for 60 degree wedges and 8 pins for 45 degree wedges. For this embodiment the ends of the pins can slide into a common hydraulic reservoir which causes the other pins to come out when one pin is pushed in. When the log holding devices are pushed into the ends of the logs this enables the pins to automatically equalize on an angled or uneven log end.

Pins extend the required distance so that circular saw blades do not cut into the material carrying the supporting holes for the sliding pins.

Pressures from log weight and growth stresses from the cut wedge can be very high. A supporting yoke is installed close to the log to support the load on the pins. The yoke is circular in nature and with an opening at the top to allow travel of the sawblade but full containment of the pins while in the sawing position.

Pins can be machined hollow at the ends to form sharp rims or have attachments at the ends to facilitate the holding of the log. Pins can be machined or have attachments to stop unwanted pin rotation causing misalignment of holding facilitating attachments.

In this first preferred embodiment logs are held by compressing the logs by moving at least one of the holding devices into the log to supply the required holding pressure in the hydraulic reservoir.

Holding devices are generally mounted on rails allowing movement along the same line as the longitudinal axis of the log. A suitable means for rails or the mounting of rails for the devices are the lower flanges of RSJ or universal type beams. These can be strengthened or doubled if required. The actual sawing device can run along the upper flange or upon rails mounted on the upper flange.

In an alternate embodiment holding devices can be locked at the required position and hydraulic pressure can be provided to push the pins into a holding position.

A further embodiment allows for individual hydraulic reservoirs for individual pins to allow for individual compression and release for individual wedges. This ability to selectively release individual segments can be used to facilitate unloading of the sawn wedges of timber in a progressive manner.

Adjustment and pressure to fingers or holding arms could be provided by mechanical means, springs, compressed air or other suitable means.

A normal sawing cycle involves mounting a log in the holding devices in relation to a chosen sawing centre, lowering the saw between the holding arms into the log, passing the saw along the log to between the holding arms at the other end to complete the cut, at which point the saw is withdrawn. The log is rotated by the holding devices the required amount, with the process being repeated until all wedges are cut from the log to complete the cycle. Sector wedges are then removed for processing to the required products.

BRIEF DESCRIPTION OF THE DRAWINGS

The present invention will now be described, by way of example, with reference to the accompanying drawings, in which:

FIG. 1 is a diagrammatic fragmentary elevation of a log indicating a radial cut of the prior art;

FIG. 2 is a diagrammatic fragmentary elevation of a log with angled end face as supported in the prior art;

FIGS. 3A and B illustrate changes in log wedge shape due to growth stresses;

FIG. 4 illustrates an end elevation of a log divided into eight equal sectors;

DESCRIPTION OF THE PREFERRED EMBODIMENTS

Figure 5A:
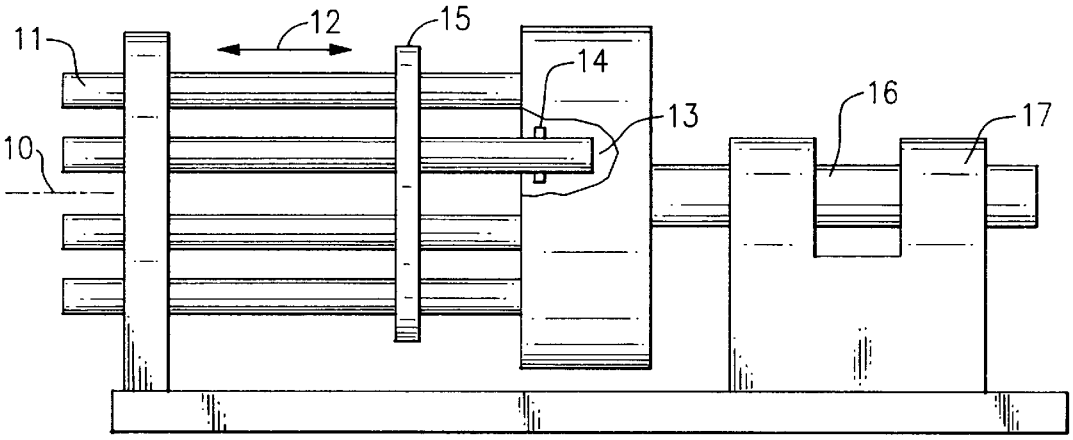
FIG. 5A is a diagrammatic side elevation of a preferred embodiment of the present invention.

In the accompanying drawings, FIG. 1 is a diagram of a log (1) with the dotted line (2) representing the restrictions to full sawing cuts caused by a holding device (3) that does not allow sawing past the holding points of the holding device. In practice, more of the log may remain uncut and wasted as a greater uncut portion is often left to stop the growth stresses causing the cut wedges to break out. Wedges which break out leave uneven distortion of the remaining wedges.

FIG. 2 shows how sectors of a log with an end (4) as little as 2 degrees to the central axis may not be held fully or at all by a rigid holding mechanism (5).

FIG. 3A diagrammatically represents the growth stresses released into two opposing wedges of timber (6) with dotted line (7) representing the former longitudinal axis of the log and the line to which a parallel saw cut was made to release the said segments. FIG. 3 (*b*) shows the relative position of the wedge sectors (6) from the log end view.

FIG. 4 represents the end section of a log divided into eight equal sectors one of which is indicated by (8) with the typical centre of holding points indicated by crosses such as (9).

Figure 5B:
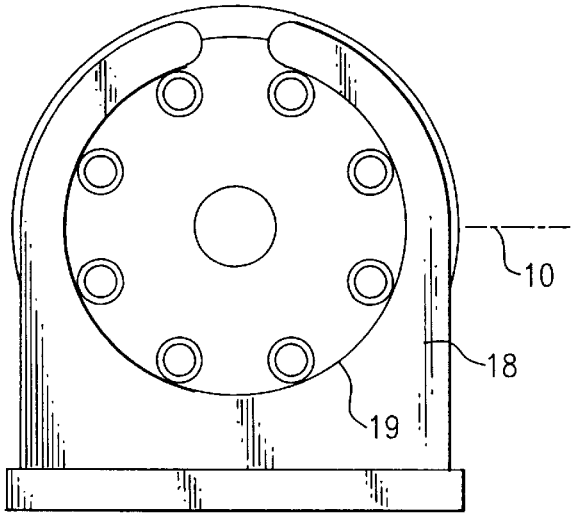
FIG. 5B is a diagrammatic end view of the log holding end of the embodiment of FIG. 5A.

FIG. 5(*a*) shows the side elevation of a preferred embodiment of the invention while FIG. 5(*b*) shows an elevation as viewed from the log holding end of the device.

In relation to these Figures:

(10) indicates the centre of rotation of the device

(11) indicates typical circular pins capable of longitudinal movement as indicated by arrow (12).

(13) indicates a common hydraulic reservoir with a typical seal (14) containing hydraulic fluid that exerts pressure on the end of pins when compressive pressure is applied to the pins.

(15) indicates a plate which is connected to the reservoir section (13), with holes for supporting the pins.

(16) indicates a supporting shaft with supporting devices (17) connected to a suitable platform or trolley device which allows rotation of the shaft to which turning, indexing, locking and thrust resisting means may be attached.

(18) indicates a supporting yoke connected to the suitable platform or trolley device which supports the main weight of the log and reduces stress in the sealing area of the hydraulic reservoir and contains the growth stress forces of the cut segments. The yoke may be lined on the internal bearing surface (19) with friction reducing material.

Figure 6:
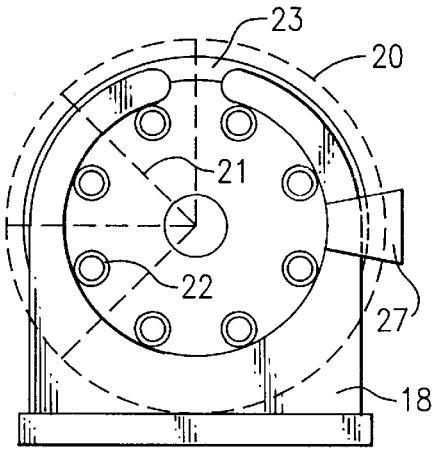
FIG. 6 illustrates the yoke 18 of FIG. 5B with a partly sawn log in place.

FIG. 6 shows, using dotted lines, the end section of a partly sawed log (20) in relation to the yoke (18), saw cuts, dotted lines (21), and holding points (22). Yoke characteristics allow for only sectors attached to other sectors passing saw cut opening (23) during the sawing operation further reducing stress on the holding pins. (27) shows a wedge that can be driven between the pins by a suitable means to act as a locking device.

Figure 7:
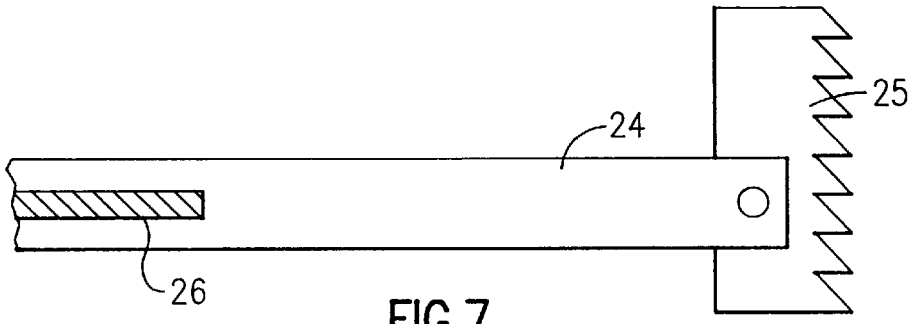
FIG. 7 illustrates a toothed attachment for holding log sectors.

FIG. 7 shows a circular holding pin (24) with a separate tooth attachment (25) to facilitate holding of log sectors. Attachments may be rigid or pivoting or shaped in particular ways, or supply holding pressure in their own right. Hatched area (26) indicates how a keyway can be machined to accept a stop that allows longitudinal movement but does not allow unwanted pin rotation.

Figure 8:
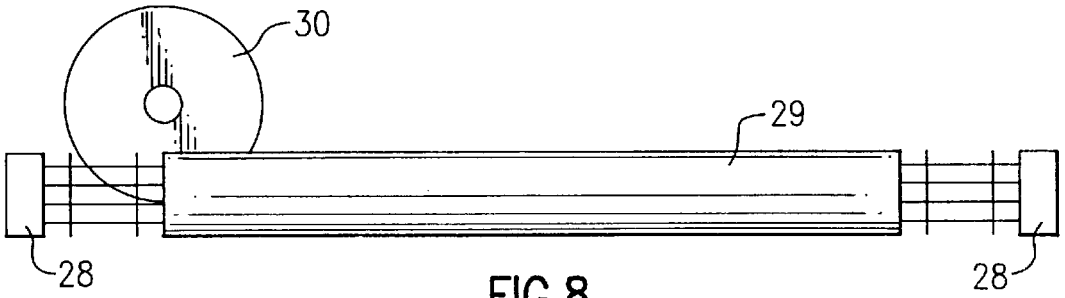
FIG. 8 illustrates two holding devices supporting opposite ends of a log.
Figure 10A:
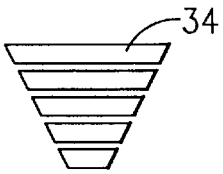
FIGS. 10A–D illustrate various sawing patterns.
Figure 10B:
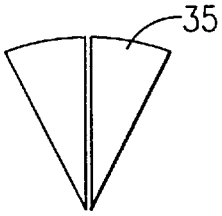
Figure 10C:
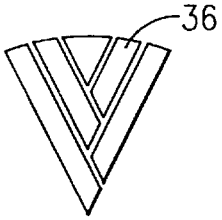
Figure 10D:
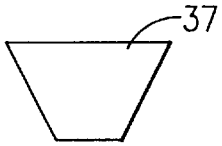

FIG. 8 represents two holding devices (28) acting at the end of a log (29) with circular saw (30) starting to cut along the log. Rotational means can be applied to one of the holding devices or both of the holding devices. Locking devices can be applied to one or both holding devices. Rotation means can be applied to one holding device with locking devices applied to one or both holding devices.

Figure 9:
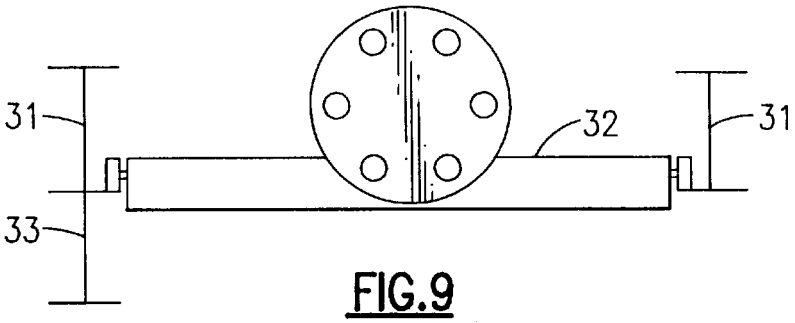
FIG. 9 illustrates a support rail arrangement for the holding devices of FIG. 8.

FIG. 9 shows the lower flange of two universal or RSJ type beams (31) forming rails or mountings for rails for holding or allowing the movement of the holding devices (32) to cut logs at different lengths and to apply pressure to the logs. Beams may be doubled as at (33) to strengthen spans and flanges. Upper flange of beams can be used to as rail or to support rails for the sawing device. Holding devices can be shifted along rails and apply compressive force by winching with cables and chains or by rack and pinion drive. Holding devices can be locked in position by rachet devices, pins in holes or by mechanical braking devices on the rails.

FIGS. 10A–D shows sawing patterns that can be selected, after the initial sawing of the logs into wedges, as part of an integrated operation. These resawing processes take place on a different machine or different machines as part of an overall process. (34) indicates a wedge resawn to backsawn boards, (35) indicates a wedge resawn to further wedges (36) indicates a wedge resawn to quartersawn boards and (37) indicates a trapezoidal timber section that may not be classed as either quartersawn or backsawn.

Figure 11:
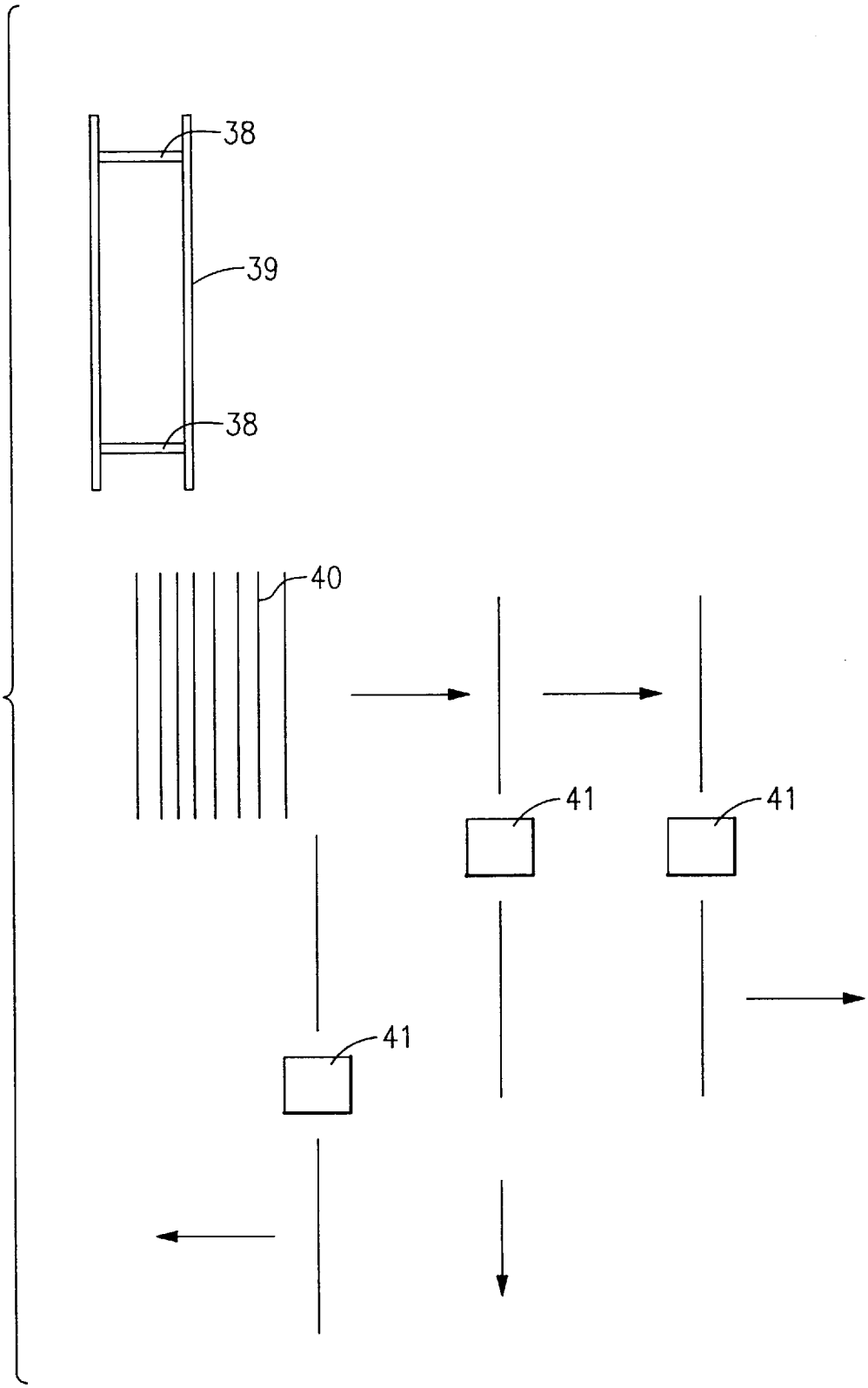
FIG. 11 is a schematic diagram of product production.

FIG. 11 shows a schematic diagram of a layout for the production of the range of products required with (38) being the holding devices at the sawing station (39) enabling the production of transferred wedges (40). The wedge can be assessed or decisions made to which of the further processing stations (41) the wedges or batches of wedges will be sent. The arrows indicate possible wedge and product flow lines. Numbers of stations can be reduced or increased according to requirement. Stations could be reduced to one or two in number with individual stations carrying out more than one required function.

I claim:

1. A holding apparatus to enable the sawing of a log to produce radially sawn sectors of timber centered on a longitudinal axis of the log and extending from end to end of the log, comprising:

a plurality of adjustable fastening devices to hold and support individual sectors of a log, at both ends thereof, before, during and after the log is sawed longitudinally by a saw blade the devices being located to allow the saw blade to pass between the fastening devices to the longitudinal axis;

a means to exert pressure on the fastening devices to hold and support the log; and a yoke to support the log, the yoke having an opening to allow the passage of the saw blade so that a complete longitudinal cut along the full length of the log can be made to the longitudinal axis to separate said sector portions into sectors.

2. A holding apparatus to enable the sawing of a log to produce radially sawn sectors of timber centered on a longitudinal axis of the log and extending from end to end of the log, comprising:

a plurality of adjustable fastening devices to hold and support individual sectors of a log, at both ends thereof, before, during and after the log is sawed longitudinally by a saw blade the devices being located to allow the saw blade to pass between the fastening devices to the longitudinal axis;

a means to exert pressure on the fastening devices to hold and support the log;

a support shaft with a brake and lock to turn the fastening devices and pressure exerting means about longitudinal axis;

a yoke to support the log, the yoke having an opening to allow the passage of the saw blade so that a complete longitudinal cut along the full length of the log can be made to the longitudinal axis;

a support platform to which is fixed a support device to brace the shaft and the yoke; and a holding device with a brake and lock, to which is fixed the support platform, that is mounted on means to provide adjustment for different size logs.

3. The holding apparatus of claim 2 where the fastening devices are rods which in use are under compression generated by the pressure exerting means to hold and support the log.

4. The holding apparatus of claim 2 where the fastening devices are screws which in use are in to support the log.

5. The holding apparatus of claim 3 where a said pressure exerting means is hydraulic and individual to each fastening device.

6. A method of holding a log to enable the sawing of a log to produce radially sawn longitudinal sectors of timber extending radially to a longitudinal axis of the log, the method comprising the steps of:

a) placing the log in a yoke to support the main weight of the log;

b) adjusting a holding device to compensate for the size of the log;

c) mounting a fastening devices in relation to the longitudinal axis;

d) applying a holding force to the fastening devices;

e) moving a saw between the fastening devices into the log to the longitudinal axis;

f) passing the saw along the log between the fastening devices to cut the longitudinal wedge; and g) withdrawing the saw from the log.

7. The method of claim 6 comprising the subsequent step of rotating the fastening devices a required amount to set up the next cut;

repeating steps a) to g) until all the wedges are cut from the log; and removing the sector wedges for processing.

* * * * *